United States Patent [19]

Smitherman et al.

[11] Patent Number: 4,561,137

[45] Date of Patent: Dec. 31, 1985

[54] FURNITURE BOLSTER

[76] Inventors: Robert A. Smitherman; Thomas A. Stáats; William E. Hoover, all of 236 Richmond Rd., Salisbury, N.C. 28144

[21] Appl. No.: 556,317

[22] Filed: Nov. 30, 1983

[51] Int. Cl.[4] ..... A47C 17/00

[52] U.S. Cl. ..... 5/12 R; 5/52; 5/465; 297/440

[58] Field of Search ..... 5/12 R, 465, 52, 431, 5/432, 11; D6/201; 297/440, 118, 455, 456

[56] References Cited

U.S. PATENT DOCUMENTS

| | | | |
|---|---|---|---|
| 3,857,120 | 12/1974 | Acker | 5/12 R |
| 3,890,658 | 6/1975 | Petersilie | 5/12 R |
| 3,951,453 | 4/1976 | Zapf | 5/12 R |
| 4,081,868 | 4/1978 | Hull | 5/12 R |

*Primary Examiner*—Alexander Grosz

*Attorney, Agent, or Firm*—Clifton Ted Hunt

[57] ABSTRACT

An article of furniture having a seat portion and an integral back portion extending upwardly from the seat portion has a bolster removably attached to the top of the back portion and a flexible cushion foldable over the top of the bolster.

3 Claims, 5 Drawing Figures

10
12
13
22
21
16
17
4
19
18
14
15
20
13'

FIG. 3
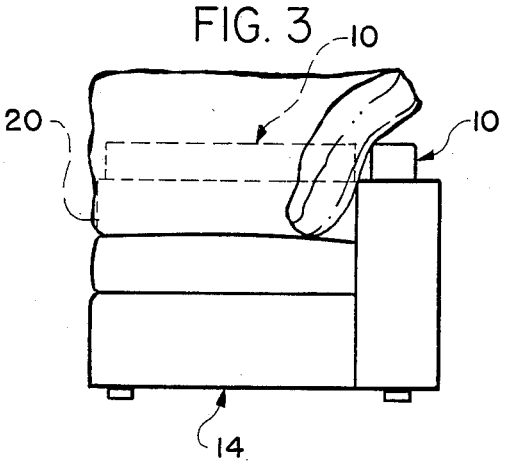
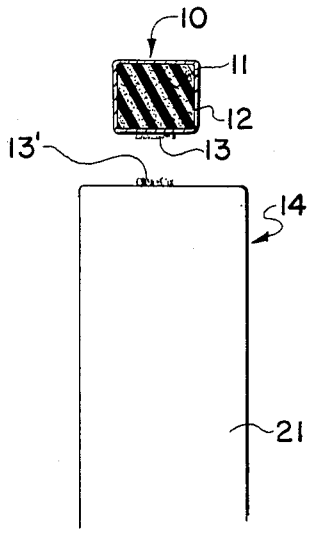
FIG. 4

FURNITURE BOLSTER

BACKGROUND OF THE INVENTION

Bolsters in the form of a long pillow or cushion have heretofore been used to support the head of a person lying on a bed, the bolster generally extending from side to side and placed under pillows and often under the bed sheets.

SUMMARY OF THE INVENTION

The furniture bolster of the present invention is preferably formed from a light cellular material and covered with the same upholstery fabric used to cover the furniture with which the bolster is used. The bolster is releasably attached to the top of the armrest and/or back of an upholstered chair of sofa and, when used, is covered with a cushion. It is intended that the bolster may be selectively removed from the furniture and the cushion placed directly on the armrest and/or back of the furniture to change the height of the cushion and the appearance of the furniture.

BRIEF DESCRIPTION OF THE DRAWINGS

FIG. 3 is a front view of one of the end pieces or the center piece of the sectional sofa shown in FIG. 1;

FIG. 4 is a sectional view taken substantially along the line 4—4 in FIG. 1.

DETAILED DESCRIPTION OF THE INVENTION

Figures 1, 2, 5:
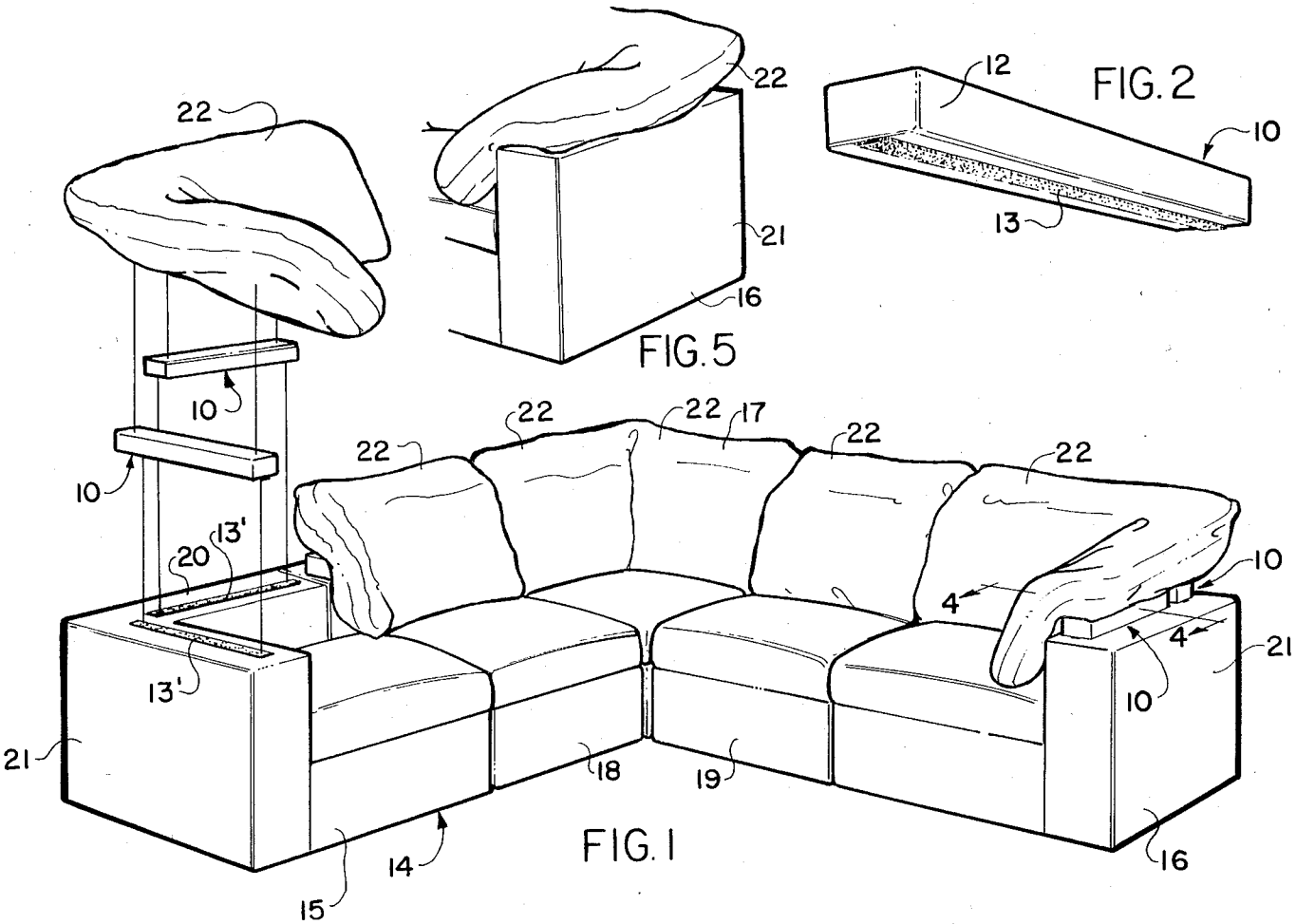
FIG. 1 is a perspective view looking at the front and two sides of a sectional sofa, showing the bolsters and cushions in exploded relation on the left side and showing the bolster and cushions in assembled relation on the right side.
FIG. 2 is a perspective view looking at one end, one side and the bottom of a bolster removed from the furniture.
FIG. 5 is a fragmentary perspective view of the right end of the sectional sofa shown in FIG. 1, but omitting the bolster.

Referring more specifically to the drawings, the numeral 10 broadly designates a bolster made in accordance with the present invention. In the illustrated embodiment, the bolster 10 comprises a core which may be a rectangular block of cellular foam 11 four (4) inches tall, five (5) inches wide and twenty-eight and one-half (28½) inches long. The block 11 is covered with an aesthetically attractive covering such as an upholstery fabric 12, preferably a fabric which is the same as or complementary to the fabric used to cover the furniture with which the bolster is intended to be used. A strip of one component of quick release hook and loop fastener material 13 is attached to the under surface of the bolster 10 as by sewing the strip 13 to the fabric 12 for engagement with a corresponding strip of the other mating component 13' of the said quick release hook and loop fastener which is sewn to the fabric on the upper surface of an arm and/or back of a piece of upholstered furniture broadly indicated at 14.

In FIG. 1 the furniture 14 is illustrated as a sectional sofa including a left end piece 15, a right end piece 16, a center piece 17 and intermediate pieces 18 and 19. The end pieces 15 and 16 and the center piece 17 are all of the same construction and are interchangeable. The intermediate pieces 18 and 19 are of the same construction and are interchangeable. Each of the designated pieces in the sofa of FIG. 1 has a back 20 and the end pieces 15 and 16 and the center piece 17 each has an angularly adjoining arm 21. The upper surface of each back portion 20 and the upper surface of each arm 21 has one component of the hook and loop fastener 13[1] attached to it for engagement with the corresponding corresponding components of hook and loop fastener material 13 on the lower surface of each bolster 10.

Cushions 22 are folded over the arms 21 and backs 20 of the furniture and the elevation of the cushions is varied as desired by insertion or removal of the bolsters 10 on top of the arms and backs (See FIGS. 1 and 5). The cushions 22 and bolsters 10 may be used with any desired style of furniture and is not limited to use with the sofa illustrated as an example.

In the drawings and specification there has been set forth a preferred embodiment of the invention, and although specific terms have been employed they are used in a descriptive sense only and not in any way as a limitation.

We claim:

1. An article of furniture comprising a frame including a seat portion and an integral back extending upwardly from the seat portion and terminating in a fixed plane above the seat portion, a bolster formed in an elongated rectangular configuration separately from the frame, means for releasably attaching the bolster to the back of the furniture in said fixed plane above the seat portion with the bolster extending upwardly from said fixed plane, and a flexible cushion extending upwardly from the seat portion, upwardly along the back and over the bolster, whereby the apparent height of the furniture may be selectively changed by removing the bolster and positioning the flexible cushion to extend upwardly from the seat portion, upwardly along the back and over the upper end of the back in said fixed plane.

2. An article of furniture according to claim 1 wherein upholstery covers the frame and separate upholstery covers the bolster.

3. An article of furniture according to claim 1 wherein said means for releasably attaching the bolster to the back of the furniture in said fixed plane above the seat portion comprises mating hook and loop fastener material fixed to the proximal surfaces of the bolster and the back of the furniture.

* * * * *